United States Patent [19]

Tatusch

[11] Patent Number: 4,770,338

[45] Date of Patent: Sep. 13, 1988

[54] FOLDED BOX WITH ANTI-TAMPER SEAL

[75] Inventor: Bruno Tatusch, Speyer, Fed. Rep. of Germany

[73] Assignee: Boehringer Mannheim GmbH, Mannheim, Fed. Rep. of Germany

[21] Appl. No.: 827,974

[22] PCT Filed: Aug. 4, 1984

[86] PCT No.: PCT/EP85/00367

§ 371 Date: Jan. 31, 1986

§ 102(e) Date: Jan. 31, 1986

[87] PCT Pub. No.: WO86/01177

PCT Pub. Date: Feb. 27, 1986

[30] Foreign Application Priority Data

Aug. 4, 1984 [DE] Fed. Rep. of Germany ..... 3428801

[51] Int. Cl.[4] ..... B65D 5/54; B65D 17/28

[52] U.S. Cl. ..... 229/102; 206/626; 206/807; 229/48 T

[58] Field of Search ..... 229/102, 132, 134, 151, 229/152, 153, 48 SA, 48 SB, 48 T; 206/620, 626, 807

[56] References Cited

U.S. PATENT DOCUMENTS

| | | | |
|---|---|---|---|
| 1,698,699 | 1/1929 | Andrews | 229/134 |
| 1,888,818 | 11/1932 | Daller | 229/132 |
| 2,896,836 | 7/1959 | Bergstein | 229/48 SA |
| 2,998,180 | 8/1961 | Dehoney, Jr. | 229/48 SA |
| 3,367,556 | 2/1968 | Whitby | 229/134 |
| 4,479,588 | 10/1984 | Davis et al. | 206/807 |
| 4,508,226 | 4/1985 | Davis et al. | 229/132 |
| 4,614,297 | 9/1986 | Davis et al. | 229/132 |

FOREIGN PATENT DOCUMENTS

| | | | |
|---|---|---|---|
| 3340798 | 3/1984 | Fed. Rep. of Germany | 229/43 |
| 2504892 | 11/1982 | France | 206/807 |
| 342162 | 1/1931 | United Kingdom | 229/102 |

*Primary Examiner*—Stephen Marcus
*Assistant Examiner*—Gary E. Elkins
*Attorney, Agent, or Firm*—Sprung Horn Kramer & Woods

[57] ABSTRACT

Folded box (2) with an anti-tamper seal, especially for the packaging of drugs. The box has a body (19) that has at least one closure component that closes off the body. A seal for protecting the box from unauthorized opening is positioned between the closure component (12, 14, 20) and the body of the box. To provide an anti-tamper seal that is simple, inexpensive to manufacture, and reliable, an aperture (22, 24, 30, 32) is positioned on the body or closure component at a point that, once the box has been closed, one area (20) of the closure component or of the body (18) will be behind and a layer (50) of hardened melting adhesive constitutes a seal bonding the closure component (12, 14, 18) and the body (19) of the box together. The invention also concerns a method of manufacturing such a box.

12 Claims, 2 Drawing Sheets

FOLDED BOX WITH ANTI-TAMPER SEAL

BACKGROUND OF THE INVENTION

The present invention concerns a folded box with an anti-tamper seal especially for the packaging of drugs, with a body that has at least one closure component that closes off the body, whereby a seal for protecting the box from unauthorized opening is positioned between the closure component and the body of the box and to a method of manufacturing such a box.

In packaging a number of different types of goods, especially drugs, it is essential to ensure that the final consumer will receive them in their original state, the state in which they leave the factory. The boxes are accordingly provided with an anti-tamper seal, meaning that they are sealed in such a way that any unauthorized opening of the package as it travels from the manufacturer to the consumer will be evident.

A number of demands that are as a whole difficult to comply with must be taken into consideration in creating an anti-tamper seal, especially a seal that is appropriate for drugs.

The seal must be extensively counterfeit-proof. Many known methods of sealing boxes that are adequate for goods, that the quality of is not highly significant and that are not likely to be subject to adulteration, are accordingly impractical for drugs.

Nevertheless, it must be possible for the pharmacist to open the container to check the contents in such a way that the box can subsequently be closed again (but without reestablishing the seal).

During packaging, it must be possible either to apply the anti-tamper seal with practically 100% accuracy or to monitor its application.

The seal must affect the design of the box as little as possible.

The cost of manufacturing the package must be increased as little as possible.

The method of applying the anti-tamper seal must be designed to prevent deceleration of the normal processing rate for packaging drugs.

A known anti-tamper seal for drug boxes consists of adhesive labels that are applied to a point on the box, which is generally parallelipipedal, at which the tuck-flap component of the closure is generally inserted under the corresponding area of the main part of the box. This type of anti-tamper seal is, however, not completely satisfactory with respect to the prevention of inevident opening and reclosing of the box. The application of adhesive labels also adds too much to the cost of packaging drugs. Specifically, special machinery must be introduced into the packaging line, leading to considerable occupation of space and to investment costs. Furthermore, the machinery available for this purpose cannot attain the requisite throughput. Even more delays result from the unavoidable necessity of replacing rolls of labels. And the labels themselves add considerably to the costs as well as undesirably affecting the design of the box.

SUMMARY OF THE INVENTION

The object of the present invention is to provide an anti-tamper seal for folded bores and a method of manufacturing such seals that will comply with the aforesaid demands.

This object is attained in accordance with the invention recited in the claims.

The invention is essentially based on the recognition that a melting adhesive of the type often employed in packaging to fasten cardboard surfaces together surface-to-surface can surprisingly also be exploited as a seal. In so doing, the melting adhesive is not conventionally applied to one surface of the cardboard and that surface to another, but the upper of two overlapping surfaces is provided with an aperture that a nozzle aims the jet of molten adhesive at. Then, while it is still hot and flowing, the molten adhesive expands over the area of the lower surface below the aperture, simultaneously wetting the edge of the aperture and penetrating under the edge into the space between the two layers of cardboard. The nozzle that applies the adhesive is aimed to wet the edge of the aperture as well.

The edge of the aperture is preferably undulating. Instead of undulations the edge can also be serrated if such does not entail technical problems in sealing the box. A contour that thus deviates from a straight line makes the seal hold more reliably, and it is practically impossible to open it with a sharp knife without leaving traces. There is also an advantage to this measure from the aspect of processing technology in that it allows wider tolerances in aiming the nozzle.

Melting adhesives can have different compositions. They are materials that are solid at room temperature and heated into a liquid form before application. They have the property of spreading over the layers to be fastened together and of forming an adhesive contact with them. Subsequent to application, adhesion is ensured when the adhesive hardens. Adhesives that form an intimate bond with the lacquer employed on the box and have an accordingly especially satisfactory adhesive action are particularly appropriate for the invention.

Also essential to the invention is that the adhesive have a high enough softening temperature. It must be high enough to leave definite traces when the seal is heated sufficiently to open.

Preferred is a melting adhesive that hardens rapidly after application. In one practical embodiment of the invention for example, the adhesive must harden in about 3 seconds to avoid deleteriously affecting the subsequent processing of the box.

Further essential characteristics of the invention and advantages that can be obtained with it will be evident from the following description of one embodiment with reference to the figures, of which

DETAILED DESCRIPTION OF THE INVENTION

Figure 1:
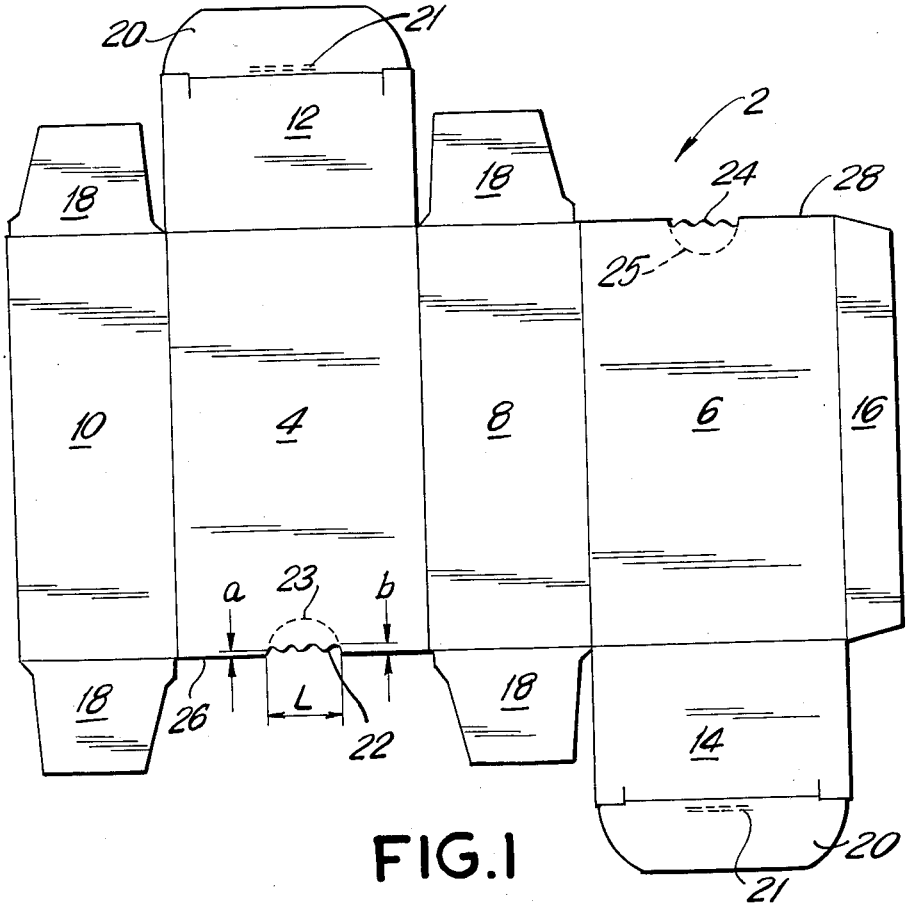
FIG. 1 illustrates a blank for a folded box in accordance with the invention.

FIG. 1 illustrates blank for producing a folded box 2 in accordance with the invention. In accordance with the terminology conventional in the pharmaceuticals-packaging industry the box has six sides—a front 4, a back 6, a left side 8, a right side 10, a bottom 12, and a top 14. Also evident in FIG. 1 are an adhesive flap 16 and four dust flaps 18. The box is produced from the blank in a known way by fastening adhesive flap 16 to the rear of right side 10 with adhesive.

To allow the box to be closed, bottom 12 and top 14, which are also called cover flaps, each have a tuck flap 20. Sides 4, 6, 8, and 10 constitute in conjunction with dust flaps 18 a body 19, whereas sides 12 and 14 are designated in conjunction with tuck flaps 20 as the closure. Everything described with respect to the box up to this point is completely conventional.

The box also has in accordance with the invention at least one aperture that allows the establishment of an anti-tamper seal. The figure shows an aperture 22 on front 4 and an aperture 24 on back 6. Apertures 22 and 24 are oblong, aperture 22 extending along the edge 26 of front 4 and aperture 24 extending along the edge 28 of back 6. Edges 26 and 28 are the ones that tuck flaps 20 are inserted under when the box is closed.

In one preferred embodiment of the invention apertures 22 and 24 have an undulating contour as will be evident from the figure. In one practically proven embodiment the undulations extend from 1 mm (depth a) to 2 mm (depth b) beyond edge 26 or 28. Apertures 22 and 24 are surrounded by rip-open perforations 23 and 25 that participate in a known way in opening folded box 2.

Figure 1A:
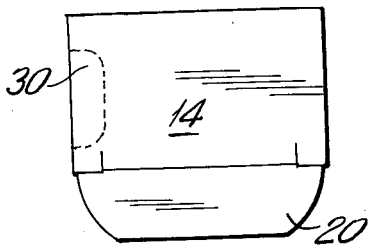
FIGS. 1A and 1B show alternative embodiments for the blank of FIG. 1.
Figure 1B:
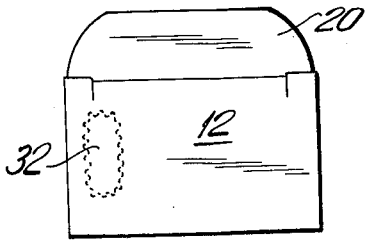

Broken lines in FIG. 1 also indicate two other points on the box that can alternatively be employed in accordance with the invention as sites for anti-tamper seals. An aperture 30 for example, as shown in FIG. 1A, can be located at one edge of a closure component 12 or 14 of an aperture 32 for example, as shown in FIG. 1A, can be located within the area of the component. Apertures of this type can, although they are less preferred, be provided instead of apertures 22 and 23 in the blank for a folded box 2 to allow the establishment of a anti-tamper seal in accordance with the invention. Common to all such apertures is that they are positioned where another cardboard area will be behind each one once the box has been closed. Each aperture is accordingly located such that, once the aperture and the cardboard area behind it have been sealed together in accordance with the invention, it will be impossible to open the box without breaking the seal. Behind each aperture 30 and 32 once the box has been closed is a dust flap 18. Behind each aperture 22 and 23. is a tuck flap 20.

The reliability of the seal is even improved in one embodiment of the invention by means of scratched areas 21 on the tuck flap 20, specifically at tuck flap 20.

Figure 2:
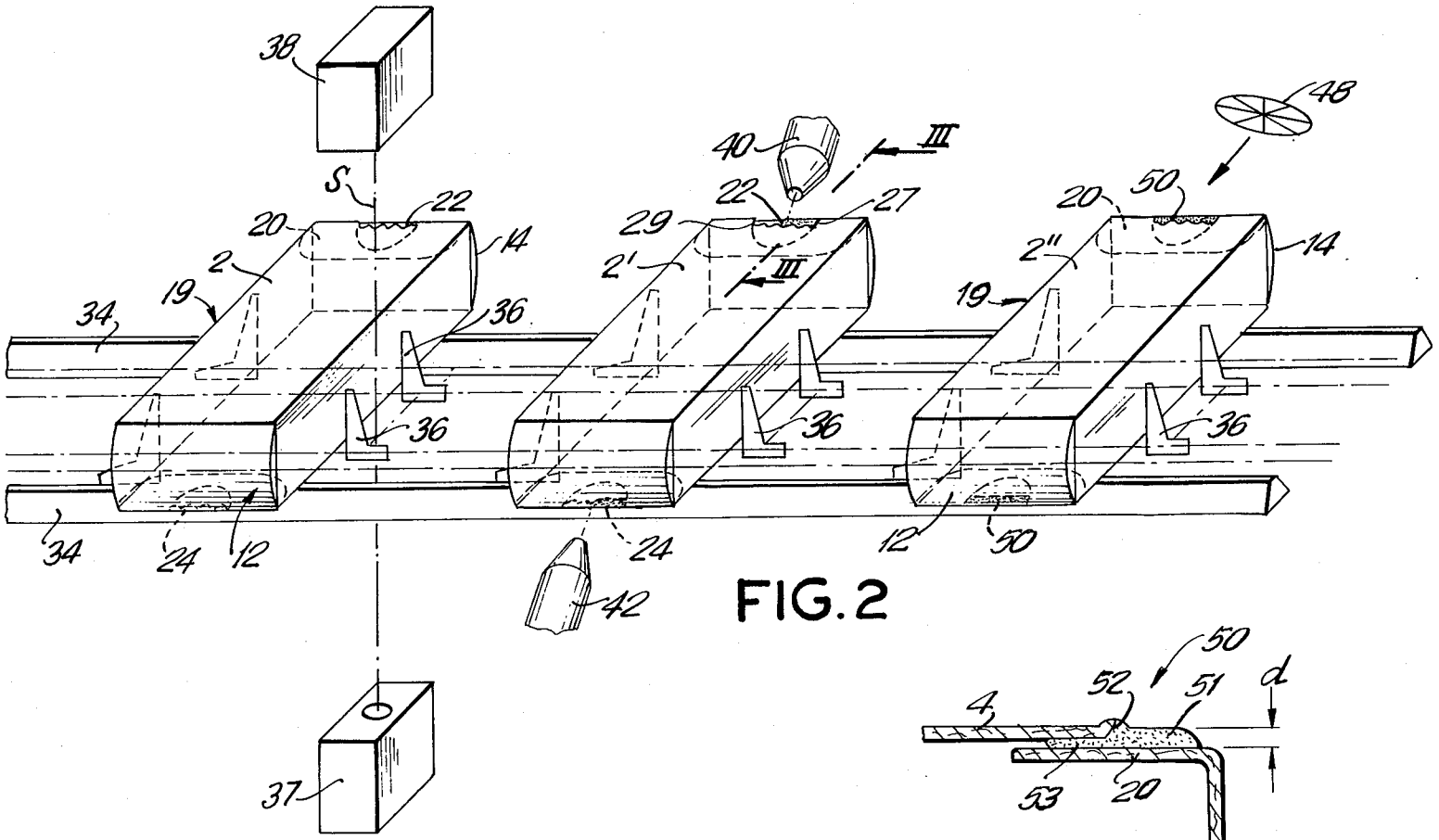
FIG. 2 is a highly schematic perspective view of a device for carrying out the method of processing such a box in accordance with the invention.

FIG. 2 illustrates how the seals are applied after the box has been closed. Boxes 2, 2' and 2'' are conveyed from left to right along two rails 34 by a mechanism that is not illustrated. The boxes are accepted by pushers 36 and conveyed parallel to the rails. FIG. 2 also illustrates various processing stations in which boxes 2, 2', and 2'' are located. Box 2 is already full and closed. It is traveling through the beam S of a light barrier created by an emitter 37 and a sensor 38 that allows its location just prior to ejection of the adhesive to be very precisely determined.

Box 2' is located where molten adhesive is being ejected onto apertures 22 and 24 by molten-adhesive ejection nozzles 40 and 42. The ejection process is initiated in relation to the positions detected by light-barrier device 37 and 38 when the end 27 of the aperture 22 that is frontmost along the direction of conveyance is in front of the adhesive nozzle and terminated when the other end 29 of the aperture is in front of the nozzle. This is also true with respect to nozzle 42 and aperture 24.

Folded box 2'' is located where the adhesive is solidifying. This process can be accelerated by means of a schematically illustrated blower 48 that cools the appropriate point on the box.

Figure 3:
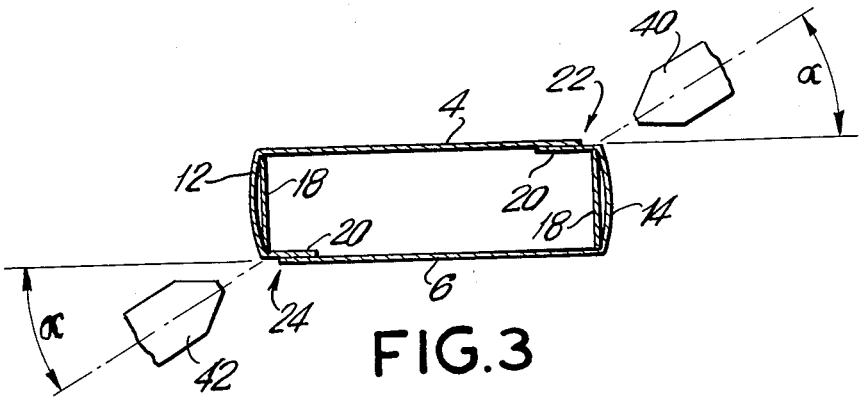
FIG. 3 is a section along the line III—III in FIG. 2.

As will be evident from FIG. 3, the nozzles 40 and 42 that eject the molten adhesive onto the box, which has in the preferred way previously described herein apertures 22 and 24 in the edges adjacent to tuck flaps 20, are aimed at an angle $\alpha$ to the sides 4 and 6 that have the apertures. This angle preferably ranges from about 5° to about 60°, with 25° to 40° being especially preferred, and 30° having in particular been proved effective in practice.

The figures illustrate as previously mentioned herein an especially preferred embodiment of the invention wherein the apertures occur at a particular site, specifically at the edges 26 and 28 opposite tuck flaps 20 and wherein the molten adhesive is ejected in a very simple way out of stationary nozzles 40 and 43 oriented at a specific angle. This combination of means results in an especially simple way in an especially reliable seal. The method is particularly simple because it only involves positioning stationary molten-adhesive ejection nozzles at appropriate points along the folded-box conveyor of a very conventional packaging machine, with one nozzle 40 or 42 being provided for each closure component 14 and 16 of a box 2.

Figure 4:
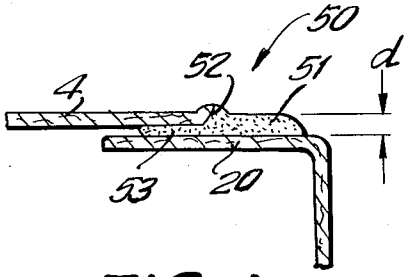
FIG. 4 illustrates one corner of the folded box in FIG. 3 with the seal highly exaggerated.

FIG. 4 is a detail of the seal. The illustration is exaggerated, especially with respect to the thickness of the layer 50 of adhesive. Essential is that the viscosity and other properties of the adhesive, especially its propagation properties, and the orientation of nozzles 40 and 42 be precisely enough matched for the seal as illustrated in the figure not only to cover the surface (area 51) below the aperture but also to wet the edge (point 52) of the aperture and to harden there. The processing conditions can easily be adjusted to prevent the adhesive from penetrating essentially beyond the edge of the aperture and induce it to follow its, undulating if necessary contour. As will also be evident from the figure, the adhesive penetrates below the edge of the aperture (point 53) and hence between tuck flap 20 and front 4, resulting in an especially stable bond. Even when this penetration is prevented with appropriate means, however, the anti-tamper seal will be adequate although less stable.

Also especially significant to a satisfactory seal is the thickness of the layer of adhesive. Proven in practice is a thickness of about 1 mm. Depending on the type of adhesive employed, however, other thicknesses between 0.2 and 2 mm can be employed.

The invention will now be explained with reference to an example.

Folded boxes measuring 50×32×82 mm and coated with a conventional lacquer were sealed with Lunatack P 54 13 Blue melting adhesive, manufactured by the firm of Fuller, Lüneburg, Federal Republic of Germany (the main constituents being hydrocarbon resin, EVA, and wax). The adhesive was applied with a Model 2202 molten-adhesive applicator manufactured by the firm of Nordson, Erkrath, FRG. The apertures in the boxes, shaped like the apertures 22 and 24 described herein, had depths a=1 mm and b=2 mm and a length L (FIG. 1) of approximately 15 mm. The seals were applied at a throughput of no more than 286 boxes a minute. The adhesive was heated to 170° C. in the applicator, attaining a viscosity of about 700 mpasec (millipascal seconds). The adhesive was applied throgh nozzles 0.26 mm in diameter from 1 cm away and at a pressure of about 30 bars. The resulting layer was approximately 1 mm thick.

Generally, a viscosity of 500 to 1500 mpasec, nozzles with a diameter of 0.2 to 0.35 mm, and an application pressure of 20 to 60 bars are especially appropriate. About 1 mg/mm$^3$ of adhesive should be applied. At an adhesive thickness of 1 g/cm$^3$ this corresponds to a layer 1 mm thick. Although thicker layers do not harm the seal, they are not appropriate due to their effect on the appearance of the package.

I claim:

1. In a folded box having a body, at least one closure component for closing off the body and having a first given area which overlaps a second given area of the body when the box is closed wherein one of the first and second given areas is exposed when the box is closed and an anti-tamper seal between the body and closure component to protect the box from unauthorized opening, the improvement wherein the anti-tamper seal comprises: means forming an aperture in the one of the first and second given areas which is exposed when the box is closed; and a layer of hardened melting adhesive between an edge of the aperture and the other of the given areas behind the aperture of form a visible seal bonding the closure component and the body together, wherein the adhesive has a softening temperature which is sufficiently high to leave perceptible traces on the box when heated to a temperature at which the seal can be opened.

2. The folded box as in claim 1, wherein the melting adhesive has a softening point of more than 80° C.

3. The folded box as in claim 1, wherein the melting adhesive has a softening point of more than 100° C.

4. The folded box as in claim 1, wherein the aperture has an edge that is at least partly undulated.

5. The folded box as in claim 1, wherein the aperture has an edge that is at least partly serrated.

6. The folded box as in claim 1, wherein the other of the given areas disposed below the aperture is at least partly scratched.

7. The folded box as in claim 1, wherein the body and closure components have edges and the aperture is oblong and is positioned at one edge of the body or of the closure component.

8. The folded box as in claim 7, wherein the closure component includes a tuck flap and the aperture is positioned at a first edge opposed to the tuck flap when the box is closed and extends from 0.5 to 5 mm into the first edge.

9. The folded box as in claim 8, wherein the aperture extends from 1 to 3 mm into the first edge.

10. The folded box as in claim 1, further comprising a rip-open perforation around the aperture for opening the box.

11. The folded box as in claim 1, wherein the layer of melting adhesive is applied to a material thickness of at least 0.5 mm.

12. The folded box as in claim 1, wherein the layer of melting adhesive is applied to a material thickness of at least 0.2 mm.

* * * * *